United States Patent [19]

Munch

[11] Patent Number: 4,646,491

[45] Date of Patent: Mar. 3, 1987

[54] PARTITION WITH PIVOTABLE DOOR FOR USE IN SHOWER STALLS

[76] Inventor: Paul-Jean Munch, Mühlenmatten 7, D-7816 Münstertal, Fed. Rep. of Germany

[21] Appl. No.: 760,493

[22] Filed: Jul. 30, 1985

[30] Foreign Application Priority Data

Dec. 14, 1984 [DE] Fed. Rep. of Germany ..... 3445642

[51] Int. Cl.[4] ..... E04F 17/06

[52] U.S. Cl. ..... 52/207; 16/235; 49/55; 49/390

[58] Field of Search ..... 49/55, 56, 390; 16/223, 16/235, 236, 262, 263, 264, 247; 52/207

[56] References Cited

U.S. PATENT DOCUMENTS

| | | | |
|---|---|---|---|
| 3,229,323 | 1/1966 | Hensgen | 16/247 |
| 4,375,736 | 3/1983 | Teckchandani | 49/390 |
| 4,388,779 | 6/1983 | Peterson | 49/390 |

FOREIGN PATENT DOCUMENTS

| | | | |
|---|---|---|---|
| 512475 | 7/1952 | Belgium | 16/235 |
| 143774 | 6/1985 | European Pat. Off. | 16/235 |
| 525150 | 5/1931 | Fed. Rep. of Germany | 16/235 |
| 2226861 | 11/1974 | France | 16/235 |
| 423176 | 4/1967 | Switzerland | 49/390 |

*Primary Examiner*—Henry E. Raduazo

*Attorney, Agent, or Firm*—Peter K. Kontler

[57] ABSTRACT

A partition which constitutes one wall of a shower stall has a fixedly mounted upright wall member and an upright door member which is pivotable relative to the wall member about a vertical axis between a closed position in which one upright marginal portion of the door member is adjacent to the inner side and overlies the adjacent upright marginal portion of the wall member and at least one open position in which the door member extends outwardly beyond the outer side of the wall member. The door member is coupled to the wall member by several hinges each of which is secured to the door member as well as to a discrete horizontal bar which can serve as a towel bar, which is adjacent to the outer side of the wall member and which is slidable relative to and is releasably connected with several bearings mounted on the wall member by distancing elements. One of the bearings can be anchored in or separably affixed to a further wall of the shower stall. Slidability of the bars relative to their bearings renders it possible to compensate for manufacturing and/or assembling tolerances.

29 Claims, 7 Drawing Figures

PARTITION WITH PIVOTABLE DOOR FOR USE IN SHOWER STALLS

BACKGROUND OF THE INVENTION

The invention relates to shower stalls or similar at least partially enclosed compartments, and more particularly to improvements in partitions or walls which can be used in such compartments. Still more particularly, the invention relates to improvements in partitions or walls of the type wherein a door member is movable with reference to and is supported by a fixed wall member and wherein the door member and/or the wall member normally consists of or comprises light transmitting material.

A shower stall with a partition wherein a mobile door member is supported by a fixedly mounted wall member is disclosed in commonly owned German Auslegeschrift No. 25 23 314. The wall member is provided with a guide rail and the door member is reciprocable along the guide rail. The guide rail can be mounted with a view to compensate for eventual manufacturing tolerances, and the wall member and/or the door member can constitute a glass pane without a frame so as to facilitate cleaning and to reduce the initial cost. The just discussed partition exhibits the drawback that the door member cannot be swung or pivoted between its open and closed positions. A swingable door member is preferred when the partition is to be provided with a relatively large door opening, i.e., when the width of the opening should exceed the width of the fixed wall member which supports the door member. Presently known partitions which are intended for use in shower stalls and have pivotable doors cannot compensate for eventual manufacturing and/or assembly tolerances. This creates problems when the door member is held in the closed position because large quantities of water are likely to escape from the shower stall when the latter is in actual use.

OBJECTS AND SUMMARY OF THE INVENTION

An object of the invention is to provide a novel and improved partition which can be used as a wall in a shower stall or the like, which has a pivotable door member and wherein the mounting of the door member on the fixed wall member is such that the position of the door member can be readily selected with a view to compensate for any and all manufacturing tolerances, to ensure adequate sealing in the closed position of the door member and to allow for any other adjustments which might become necessary during and/or subsequent to initial assembly.

Another object of the invention is to provide the partition with novel and improved means for movably coupling the door member to a fixed wall member.

A further object of the invention is to provide the coupling means with novel and improved means for permitting adjustments of the door member in any one of two or more different directions.

An additional object of the invention is to provide novel and improved means for securing the coupling means to the wall member and to the door member.

Still another object of the invention is to provide a shower stall which embodies the above outlined partition.

A further object of the invention is to provide a novel and improved method of mounting a pivotable door member in a shower stall or in an analogous compartment.

The invention is embodied in a partition, particularly for use in shower stalls as one of the walls surrounding the space which is occupied by the person or persons taking a shower. The partition comprises a fixedly mounted wall member which is disposed in a vertical or substantially vertical plane and is preferably adjacent to a fixed wall which is also disposed in a vertical plane extending at least substantially at right angles to the plane of the wall member. The partition further comprises a door member and means for movably coupling the door member to the wall member. The coupling means comprises a hinge defining a preferably vertical or substantially vertical pivot axis about which the door member is swingable with reference to the wall member between a closed position in which the plane of the preferably vertical plate-like door member is preferably parallel to the plane of the wall member and at least one open position, and means for mounting the hinge on the wall member so as to permit for adjustments of the door member with reference to the wall member at least in directions at right angles to the pivot axis. The wall member and/or the door member preferably includes or constitutes an upright light transmitting pane, such as a thick glass pane or a relatively thick pane made of transparent or translucent synthetic plastic material. The two members have neighboring elongated marginal portions which overlap each other in the closed position of the door member. The mounting means is preferably disposed (either entirely or to a large extent) at the outer side of the wall member and the marginal portion of the door member preferably overlaps the marginal portion of the wall member at the inner side of the wall member in the closed position of the door member.

In accordance with a presently preferred embodiment of the invention, the mounting means comprises a substantially horizontal elongated solid or tubular bar or rod-shaped component having a first portion which supports the hinge and a second portion which is reciprocable in the aforementioned directions at right angles to the pivot axis in at least one preferably tubular and/or socket-shaped bearing of the mounting means. The elongated component of the mounting means is preferably slidable in its bearing or bearings in substantial parallelism with the plane and at the outer side of the wall member. A grub screw or other suitable means can be provided for releasably fixing the component of the mounting means to at least one of the bearings or to the single bearing of the mounting means.

The hinge comprises a first section which is rigid with the first portion of the component, a second section which is rigid with the door member and a pintle which connects the two sections to each other in such a way that the second section and the door member are swingable about the pivot axis, i.e., about the axis of the pintle. One of the sections (preferably the second section) is at least substantially arcuate (it can extend along an arc of approximately 90 degrees) and is adjacent to but spaced apart from and extends around the marginal portion of the wall member at least in the closed position of the door member. The first section of the hinge is or can be integral with the first portion of the aforementioned component.

The mounting means preferably comprises a substantially tubular first bearing which slidably receives the second portion of the component and a preferably socket-shaped second bearing which receives the free end of the second portion of the component. The first bearing is disposed between the second bearing and the hinge and that part of the component which extends between the two bearings can constitute a towel bar. The socket determines one end position of the component with reference to the wall member, and the socket includes an end wall which can be secured to the aforementioned fixed wall by a screw, a bolt or other suitable fastener means. Alternatively, the means for affixing the second bearing to the fixed wall can include an arm which is rigid with the second bearing and can be directly secured to the fixed wall. Still further, the second bearing can be rigidly affixed to the wall member by a first affixing device (e.g., a distancing element) and the first affixing device can be secured to the fixed wall by an arm or another second affixing device. Each of the bearings can be connected to the wall member by a suitable distancing element in the form of a tubular or solid member extending at right angles to the plane of the wall member. For example, each distancing element can comprise or constitute a spacer which is rigid or integral with the respective bearing and a fastener having a first portion (e.g., a screw head or a rosette) at the inner side of the wall member and a second portion (e.g., an externally threaded shank) extending through the wall member and engaging with the respective spacer.

Means can be provided for adjustably affixing each of the bearings to the wall member. For example, each such affixing means can comprise a distancing element which is rigid with the respective bearing, a rotary element which is rotatably carried by the wall member and a fastener which is provided on the distancing element and engages with and is eccentric relative to the rotary element so that the position of the distancing element and hence of the respective bearing relative to the wall member is changed in response to angular displacement of the rotary element relative to the corresponding distancing element about the fastener. The latter can be said to constitute a crank pin which is anchored in the distancing element and the rotary element can be said to constitute a crank arm which can turn about the axis that is defined by the fastener. When the fastener is driven home, the rotary element is held in a selected angular position. Such adjustability renders it possible to raise or lower the component of the mounting means with the door member to compensate for eventual manufacturing tolerances.

The means for securing the preferably arcuate first section of the hinge to the door member preferably comprises a fastener having a head or an otherwise configurated enlarged portion at the inner side of the door member and a second portion (e.g., a shank) which extends through the door member and engages with the arcuate second section of the hinge at the outer side of the door member. The just mentioned fastener is preferably adjacent to but still spaced apart from the marginal portion of the door member.

The door member preferably extends beyond the outer side of the wall member in each or at least in some of its open positions. In other words, the door member is preferably swingable outwardly to an open position and inwardly toward or to its closed position.

A grub screw is preferably provided to hold the aforementioned component of the mounting means against rotation in the bearing or bearings of the mounting means. For example, the component can have a substantially circular outline and can be provided with an external spline for an internal tooth in at least one of the bearings. Alternatively, the spline can be provided in the internal surface of a bearing and the component is then formed with an external tongue which extends into and is guided in the spline for reciprocatory movement but is held against angular movement in the bearing or bearings. It is also possible to employ a tubular or solid rod-shaped component having a polygonal outline and being slidable longitudinally in the bearing or bearings having a complementary outline.

The door member can be swingably secured to the wall member by several coupling means which are disposed at different levels and whose hinges define a common pivot axis for the door member.

The novel features which are considered as characteristic of the invention are set forth in particular in the appended claims. The improved partition itself, however, both as to its construction and its mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
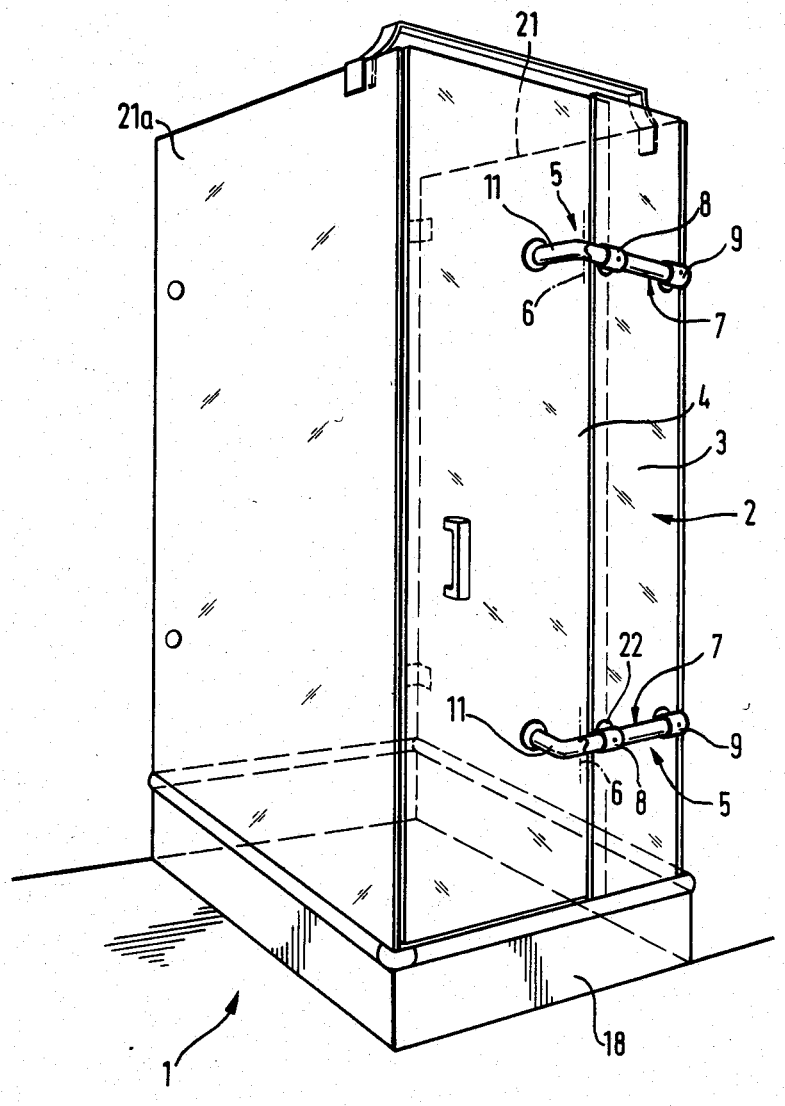
FIG. 1 is a schematic perspective view of a shower stall including a partition which is constructed and mounted in accordance with one embodiment of the present invention, the door member of the partition being secured to the wall member by two coupling means and being shown in the closed position.
Figure 3:
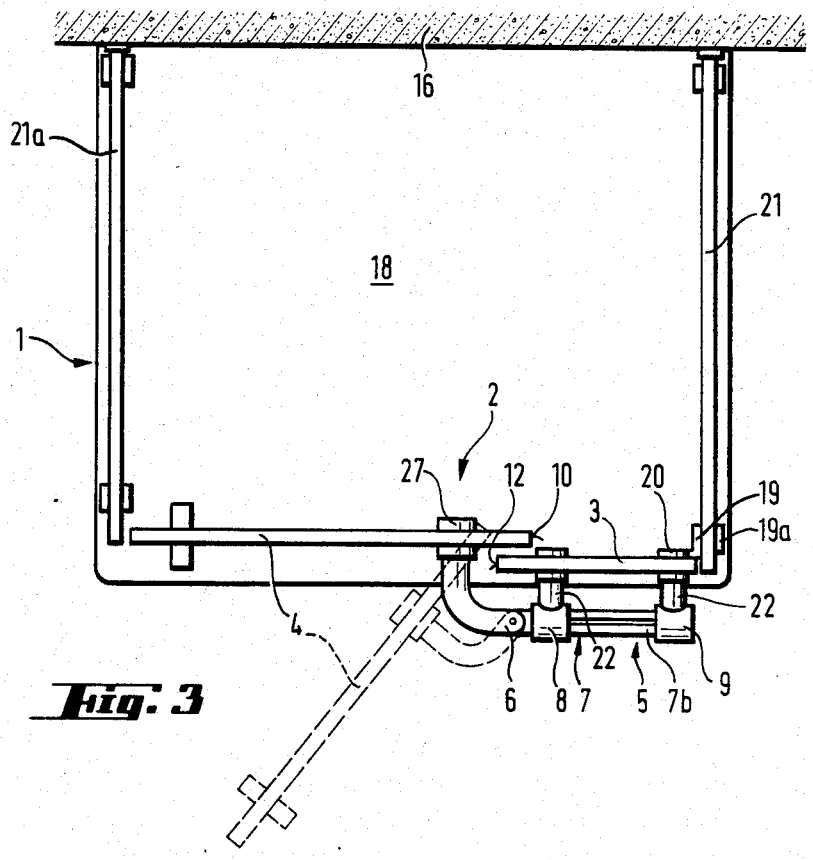
FIG. 3 is an enlarged plan view of the shower stall of FIG. 1 showing one open position of the door member by broken lines and further showing the manner in which the horizontal components of the mounting means can be secured to a fixed wall member of the shower stall.

FIG. 1 shows a shower stall 1 with a partition 2 which constitutes its front wall and embodies one form of the invention. The partition 2 includes a fixed upright plate-like wall member 3, an upright plate-like door member 4 and two coupling devices 5 which are disposed at different levels and enable the door member 4 to be swung between the closed position of FIG. 1 and several open positions one of which is shown in FIG. 3 by broken lines and in which at least a portion of the door member extends beyond the outer side of the wall member 3. It will be noted that the width of the door member 4 can exceed the width of the wall member 3 as measured in a direction from a fixed wall 21 to another fixed wall 21*a* of the shower stall 1. The manner in which the wall member 3 and the walls 21, 21*a* are anchored in the base 18 of the stall 1 forms no part of the invention. The walls 21 and 21*a* can extend forwardly from a building wall 16.

The wall member 3 and/or the door member 4 preferably constitutes a relatively thick and stable pane of glass or light-transmitting synthetic plastic material without a frame to facilitate cleaning, to reduce the initial cost and to simplify mounting in the base 18 and attachment (of the member 3) to the wall 21.

Figure 4:
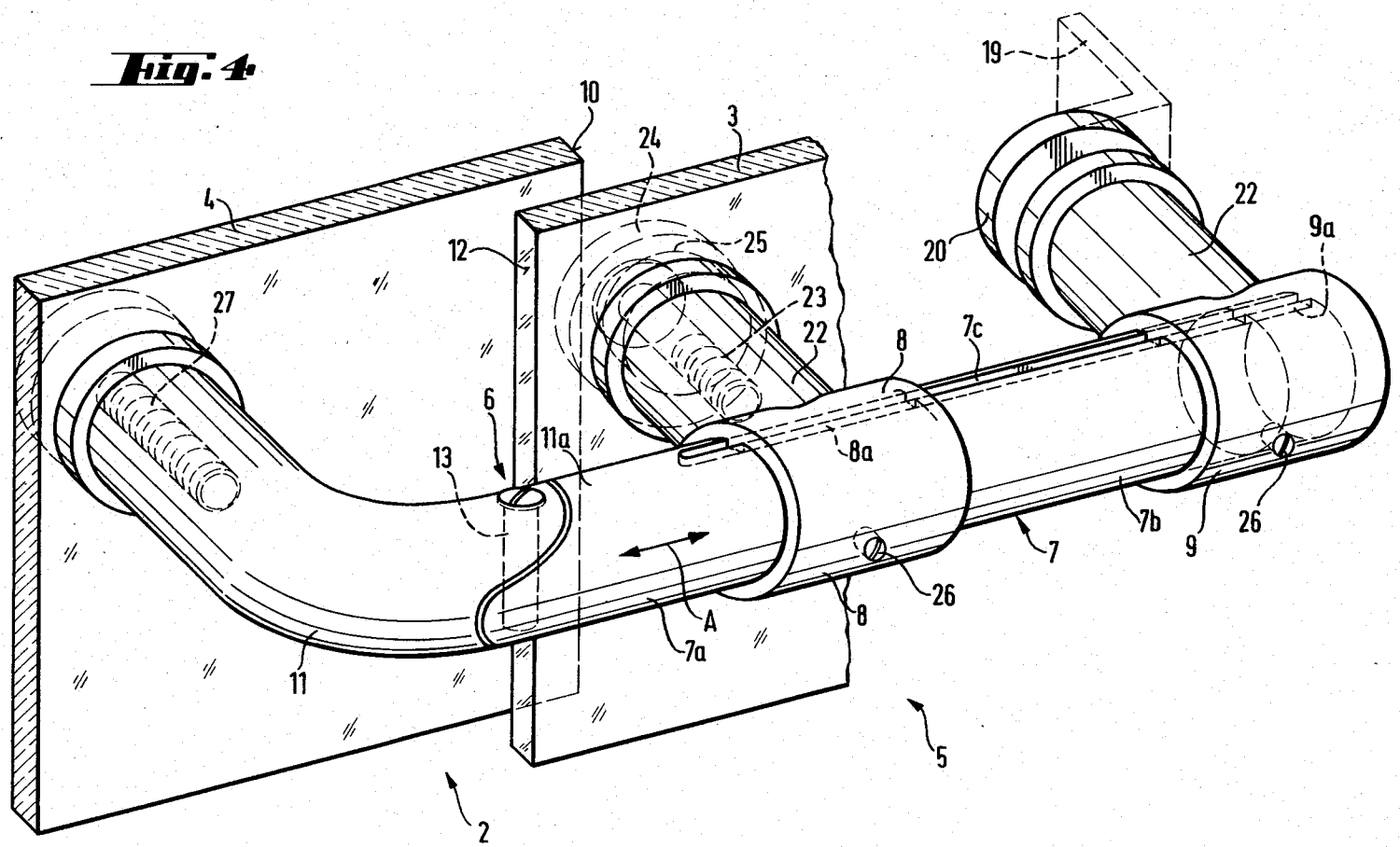
FIG. 4 is an enlarged perspective view of a hinge, of a mounting means with two bearings, of the means for securing one section of the hinge to the door member, and of the means for securing the bearings to the wall member.

Each coupling device 5 serves to swingably connect the door member 4 to the fixed wall member 3 for movement about a vertical pivot axis which is defined by several aligned pintles 13 and to allow for adjustment of the door member in at least two directions, namely at least substantially at right angles to the common axis of the pintles 13 (note the double-headed arrow A in FIG. 4). Each of the two coupling devices 5 comprises a hinge 6 which includes the respective pintle 13 and means for mounting the respective hinge 6 on the fixed wall member 3 so as to allow for adjustments of the door member 4 in directions which are indicated by the arrow A and to thus compensate for assembling, manufacturing or other tolerances.

The mounting means of the coupling device 5 which is shown in FIG. 3 comprises a substantially horizontal elongated bar- or rod-shaped component 7 (hereinafter called bar for short) and two bearings 8, 9 which serve to adjustably mount the bar 7 at the outer side of the fixed wall member 3. The bar 7 has a first portion 7*a* (FIG. 4) which is integral with a straight section 11*a* of the respective hinge 6 and a second portion 7*b* which slidably extends through the tubular sleeve-like bearing 8 and into the socket- or cup-shaped bearing 9. That part of the bar 7 which extends between the bearings 8 and 9 can be used as a towel bar. The portion 7*b* is preferably parallel to and is spaced apart from the outer side of the fixed wall member 3.

It is also possible to install the portion 7*b* of the bar 7 in a single bearing 8 or 9 but several aligned bearings are preferred in order to enhance the stability of the bar and to ensure that it remains in a preselected orientation. As can be seen in FIGS. 4, 5, 6 and 7, the portion 7*b* of the bar 7 can be moved longitudinally toward or away from the fixed wall 16 or 21 and can be releasably fixed in a selected axial position by one or two grub screws 26 or the like. The hinge 6 shares the axial movements of the bar 7 and moves the swingable door member 4 toward or away from the bearing 8. This determines the extent to which the longitudinal vertical marginal portion 10 of the door member 4 overlaps the adjacent longitudinal vertical marginal portion 12 of the wall member 3 in the closed position of the door member 4 (compare FIGS. 5 and 6 which respectively show the door member 4 in its right-hand and left-hand end positions). Such adjustments in the directions which are indicated by the arrow A are desirable and advantageous in order to compensate for eventual manufacturing or assembling tolerances and to prevent leakage of water between the marginal portions 10 and 12 in the closed position of the door member 4. The marginal portion 10 overlies the marginal portion 12 at the inner side of the wall member 3 (i.e., in the interior of the shower stall 1) when the door member 4 is held in the closed position of FIG. 1, 5 or 6. The difference between the two end positions of the bar 7 with reference to the bearings 8 and 9 need not be very pronounced but it should suffice to compensate for the aforediscussed tolerances and to prevent excessive or any leakage of water when the shower stall 1 is in actual use.

Figure 5:
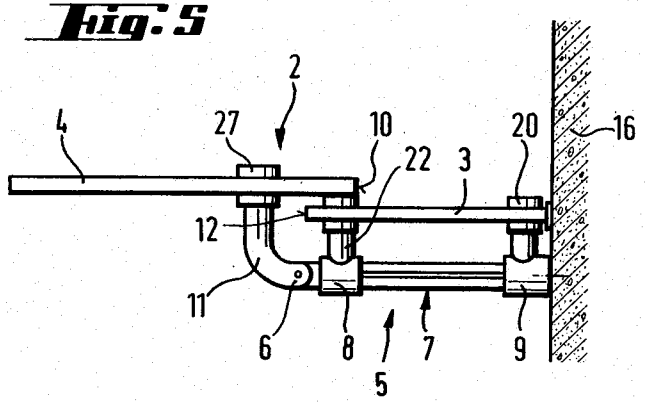
FIG. 5 is a fragmentary plan view similar to that of FIG. 3 and showing the horizontal component of a mounting means in one of its end positions at a minimum distance from a fixed wall of the shower stall.
Figure 6:
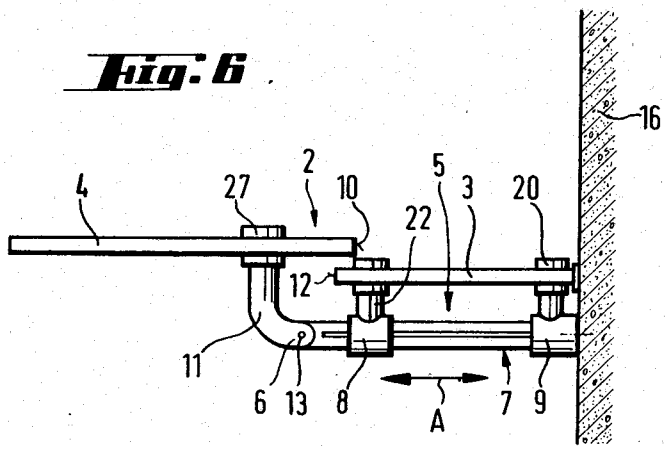
FIG. 6 illustrates the structure of FIG. 5 but with the horizontal component in the other end position at a maximum distance from the fixed wall of the shower stall.

FIGS. 5 and 6 further show that the section 11 of the hinge 6 is arcuate and extends around and is spaced apart from the marginal portion 12 of the wall member 3 in each angular position (including the closed position) of the door member 4. The position of the pintle 13 relative to the marginal portion 12 and the extent to which the marginal portion 10 of the door member 4 overlaps the marginal portion 12 are selected with a view to ensure that the marginal portion 10 can bypass and move around the marginal portion 12 during pivoting of the door member 4 between its closed position and any of the several open positions including that which is shown by broken lines in FIG. 3.

Figure 2:
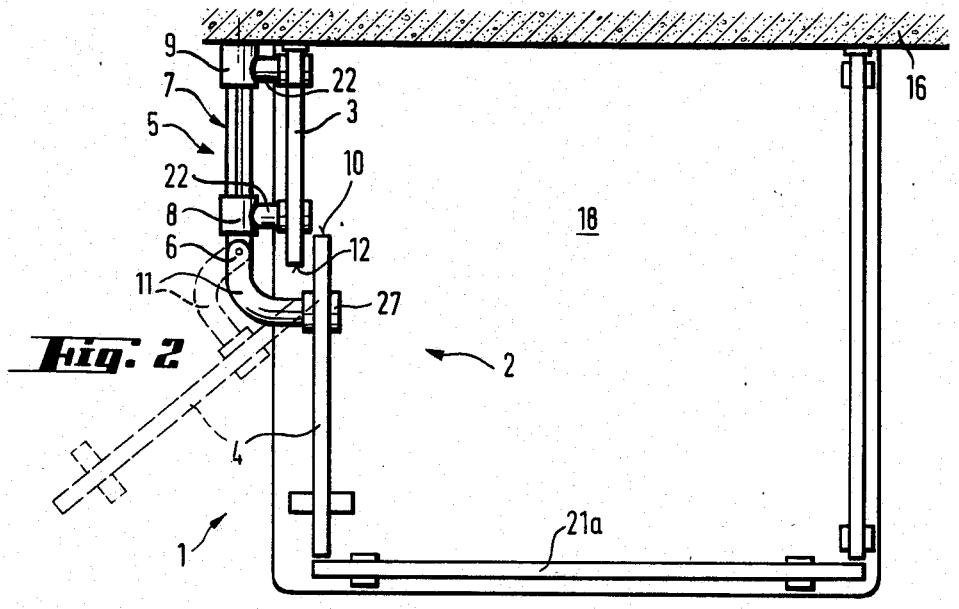
FIG. 2 is an enlarged plan view of a modified partition wherein the wall member is adjacent to a fixed building wall and the horizontal component of the mounting means of each coupling means is secured to such building wall.
Figure 7:
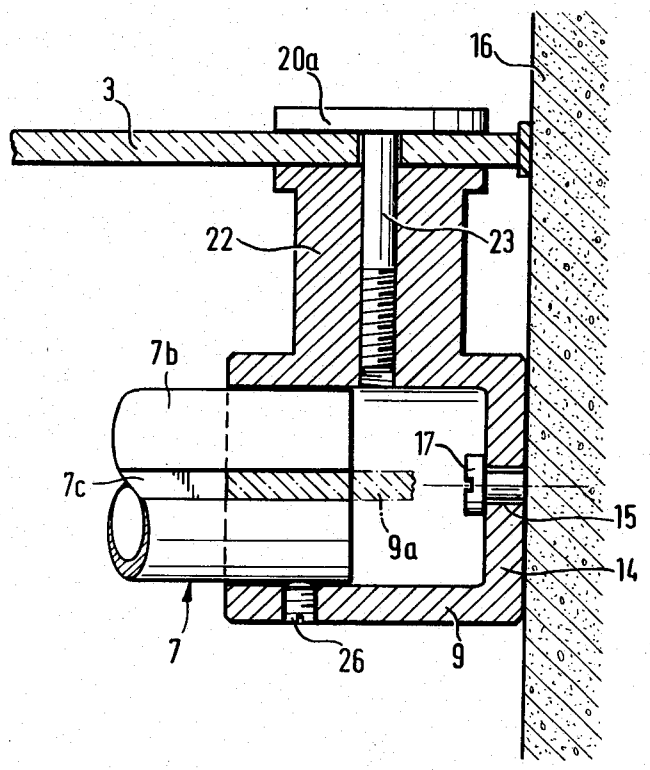
FIG. 7 is an enlarged fragmentary plan view of a portion of a modified partition showing one presently preferred mode of securing one of the bearings to the wall member and to a fixed wall of the shower stall.

As can be seen in FIG. 7, the cup-shaped or socket-like bearing 9 of the means for mounting the hinge 6 on the wall member 3 has an end wall or bottom wall 14 which is formed with a central opening 15 for the shank of a screw or an analogous fastener 17 which extends into the adjacent fixed wall 16 or 21, depending upon whether the partition 2 constitutes the front wall of the shower stall 1 (as shown in FIGS. 1 and 3) or a sidewall (as shown in FIGS. 2 and 7). The bearing 9 performs the dual function of forming part of the means for mounting the hinge 6 on the wall member 3 and of limiting the extent of rightward movement of the bar 7 as viewed in FIG. 7.

As can be seen in FIG. 3, the bearing 9 can be indirectly affixed to the fixed wall 21 of the shower stall 1 by an arm 19 (shown in FIG. 4 by broken lines) which is rigidly but preferably separably secured to the wall member 3 by a fastener 20, e.g., a bolt or screw having a customary head or a rosette at the inner side of the wall member 3 and a shank which extends through a hole in the wall member 3 and mates with the adjacent end portion of a distancing element or spacer 22 serving as a means for separably affixing the bearing 9 to the wall member 3 in such a way that the bar 7 is held at a preselected distance from the outer side of the member 3. The wall 21 extends at right angles to the wall member 3 and is secured to the base 18 and/or to the building wall 16. The right-hand end of the portion 7*b* of the bar 7 shown in FIG. 3 extends beyond the bearing 9, i.e., the latter can constitute a tubular element which is identical with or similar to the bearing 8. The bar 7 can be held in a selected axial position by the aforementioned grub screw(s) 26.

The bearing 8 is also connected to the wall member 3 by a distancing element or spacer 22 which is or can be identical with the distancing element 22 for the bearing 9 of FIG. 3. The arm 19 of FIG. 3 can be separably secured to the wall member 3 by the fastener 20 and it can be separably secured to the wall 21 by a further fastener 19*a* which may but need not be identical with the fastener 20. FIG. 7 shows in greater detail a somewhat modified fastener 20*a* whose enlarged portion or head is adjacent to the inner side of the wall member 3 and whose externally threaded shank 23 extends through an opening of the wall member 3 and into a tapped bore 22*a* of the distancing element 22 for the bearing 9.

Referring again to FIG. 4, there is shown a modified means for affixing the distancing element 22 for the bearing 8 to the wall member 3 in such a way that the bar 7 is adjustable in the directions which are indicated by the arrow A as well as up and down, i.e., in the direction of the axis of the pintle 13, in order to allow for even more accurate positioning of the door member 4 in an optimum position with reference to the wall member 3. The modified affixing means comprises a rotary element 24 which is secured (in a manner not specifically shown in FIG. 4) to the outer side of the wall member 3 for rotation about its own axis and is secured to the adjacent end portion of the distancing element 22 for the bearing 8 by a fastener 25 whose axis is parallel to the axis of the rotary element 25. Thus, when the element 24 is rotated relative to the wall member 3 about its own axis, the fastener 25 causes the respective distancing element 22 to move up or down and sideways with the bearing 8 and bar 7, i.e., with the door member 4. It is clear that, if the distancing element 22 for the bearing 8 is adjustably secured or affixed to the wall member 3 in a manner as shown in FIG. 4, the distancing element 22 for the bearing 9 is affixed to the wall member 3 in a similar or analogous fashion so as to ensure that the level of the bearing 9 can be altered together with the level of the bearing 8 or vice versa. The enlarged portions of the fasteners 20 and 24 can constitute rosettes to enhance the appearance of the respective coupling devices 5. The affixing means including the distancing element 22 for the bearing 8 of FIG. 4, the rotary element 24 and the associated fastener 25 can also serve to effect certain adjustments of the bearing 8 in the directions which are indicated by the double-headed arrow A, i.e., at right angles to the common axis of the pintles 13. This further enhances the adjustability of the door member 4 relative to the fixed wall member 3. Such adjustability of the bearings 8 and 9 relative to the wall member 3 is desirable because it renders it possible to reduce the likelihood of jamming of the lower marginal portion of the door member 4 at the base 18 of the shower stall 1 as well as to reduce the likelihood of escape of water from the base 18 as a result of splashing when the stall 1 is in use.

The means for securing the arcuate section 11 of the hinge 6 to the door member 4 can comprise a fastener 27 (see the left-hand portion of FIG. 4) whose enlarged portion is adjacent to the inner side of the door member (reference being had to the closed position of the door member) and whose smaller-diameter portion or shank extends through an opening in the door member 4 and into a tapped bore in the adjacent end face of the section 11. The enlarged portion of the fastener 27 can have an eye-pleasing design or a purely utilitarian (e.g., polygonal) design so that it can be readily engaged and rotated by a suitable tool. The fastener 27 is preferably adjacent to but still spaced apart from the vertical marginal portion 10 of the door member 4. This renders it possible to move the door member 4 to a closed position (as shown in FIGS. 1, 2, 3, 5 and 6) in which the marginal portion 10 overlies the marginal portion 12 and is adjacent to the inner side of the wall member 3. Moreover, such positioning of the fastener 27 renders it possible to gain access to the entire marginal portion 10 for the purpose of cleaning. This can be readily seen by referring to the broken-line open position of the door member 4 in FIG. 3 or 4.

The distance between the bearings 8 and 9 can be increased beyond or reduced below that which is shown in FIG. 1, 2, 3, 4, 5 or 6. It is desirable to maintain between the bearings 8 and 9 a distance which renders it possible to place a towel around that part of the bar 7 which extends between the two bearings. This enhances the versatility of the bar and reduces the conspicuousness of the respective coupling device 5. Furthermore, it is not necessary to install a discrete towel bar on the housing wall 16 or elsewhere in the bathroom wherein the shower stall 1 is installed. Each of the two bars 7 shown in FIG. 1 can be used as a towel bar, especially if the lower coupling device 5 is mounted at a reasonable distance from the floor.

That part of the bar 7 which extends between the bearings 8 and 9 can further serve as a secure handgrip means for a handicapped person, for a hospitalized person, for a person recuperating at home from an injury or illness, or for an elderly citizen. Furthermore, each and every person using the shower stall 1 can utilize the bar 7 as a handle in order to reduce the likelihood of slippage on the wet floor of a bathroom or shower room.

While it is equally possible to install the two coupling devices 5 of FIG. 1 at the inner side of the fixed wall member 3, it is often preferred to mount such coupling devices at the outer side of the member 3, i.e., to render the door member 4 pivotable to the outside so that at least a portion of the door member extends beyond the outer side of the wall member 3 when the door member is moved to a partly or fully open position.

The means for preventing rotation of a bar 7 which has a circular outline can comprise an axially parallel groove (see the groove 7*c* of FIG. 7) which is provided in the peripheral surface of such bar and a complementary tongue (note the tongue 9*a* of FIG. 7) which is provided in the bearing 8 and/or 9. It is clear that the groove can be provided in the bearing 8 or 9 and the tongue can be provided at the exterior of the bar 7. If the bar has a partially or fully polygonal outline (see FIG. 4), at least one of the bearings 8, 9 can be provided with an internal flat (note the flat 8*a*) which engages the adjacent external facet of the bar 7 and holds the latter against rotation about its axis. If the bar 7 has a circular outline and the bearing 8 and/or 9 does not have any specifically designed means for holding the bar against rotation therein, the aforementioned screw or screws 26 serve to releasably hold the bar against axial as well as against angular movement relative to the bearings. As can be seen in FIG. 7, each bar 7 can constitute an elongated tube; however, it is equally within the purview of the invention to utilize bars which are solid pieces of metallic or plastic material.

The improved partition 2 exhibits the advantage that the door member 4 can be adjusted with reference to the wall member 3 and other walls of the shower stall 1 in a number of different directions (particularly at right angles to the common vertical or substantially vertical axis of the pintles 13) in spite of the fact that it is swingable between a closed position and one or more different open positions. Furthermore, the the partition 2 is of eye pleasing appearance and its bar or bars 7 can serve the additional function or functions of supporting one or more towels, wash cloths or the like as well as of serving as convenient handles for an injured person, an elderly person or any other person utilizing the shower stall. The members 3 and 4 can be readily cleaned because they need not be framed so that their marginal portions are readily accessible, at least when the door member 4 is moved to an open position. The absence of any frame or frames also enhances the appearance of the partition and contributes to its lower initial cost. Utilization of members 3 and 4 which transmit light is desirable and advantageous because this enables a user leaving the shower stall 1 to readily detect the bars 7 and other parts of the coupling devices 5, to readily locate the towel or towels on such bar or bars as well as to reduce the likelihood of colision with the constituents of the coupling device or devices. Still further, the parts of the coupling devices 5 can be readily configurated, finished and/or dimensioned in such a way that they also contribute to the appearance of the partition 2 and of the entire shower stall.

The provision of several bearings for each of the bars 7 is desirable and advantageous because this enhances the stability of the respective coupling device 5 and renders the bars safer for use as handles by convalescents, elderly persons or any other persons using the shower stall which embodies the improved partition.

If desired, the marginal portion 10 and/or 12 can be provided with a longitudinally extending sealing strip (not specifically shown) which engages the other marginal portion in closed position of the door member 4 to further reduce the likelihood of leakage of water when the shower stall is in use. It has been found that, at least in many instances, a simple adjustment of the extent of overlap of the marginal portions 10 and 12 in the closed position of the door member 4 suffices to prevent escape of any water when the door member is held in the closed position.

The section 11 of the hinge 6 which is shown in FIG. 4 can be replaced with a straight section if the section 11*a* or the portion 7*a* of the bar 7 has an arcuate or a similar shape (e.g., the shape of the letter L). The maximum extent of adjustability of the door member 4 relative to the wall member 3 in directions which are indicated by the arrow A can be increased beyond that shown in FIGS. 5 and 6 as long as the marginal portions 10, 12 prevent escape of water in the closed position of the door member and as long as the marginal portion 10 can travel around the marginal portion 12 during movement of the door member 4 to or from its closed position. For example, and referring to FIG. 6, the marginal portion 10 can be located to the left of the illustrated position in the left-hand end position of the bar 7 as long as it at least slightly overlaps the inner side of the wall member 3 in the region of the marginal portion 12. By the same token, the section 11 can be closer to the marginal portion 12 than shown in FIG. 5 in the right-hand end position of the bar 7, as long as the marginal portion 10 can move along an arc and around the marginal portion 12 during movement of the door member 4 to or from the closed position of FIG. 5.

If the mounting means for the hinges 6 employ bearings 9 of the type shown in FIG. 7, i.e., bearings with end walls 14 which limit the extent of movability of the respective bars 7 toward the fixed wall 16, and if the bar is to be moved toward the wall 16 beyond the position which is actually shown in FIG. 7, the illustrated bar 7 can be replaced with a somewhat shorter bar or the bar can be shortened to a desired degree so as to allow for an increase of the extent of overlap of the marginal portions 10 and 12 in the closed position of the respective door member 4.

The provision of means (such as the arm 19 of FIGS. 3, 4 and 7) for directly or indirectly affixing the bearing 9 to the wall 16 or 21 is desirable and advantageous when it is necessary to enhance the stability of the stall shower, i.e., to secure the wall member 3 to the wall 16 or 21 in the customary way as well as by means of the coupling devices 5.

It is clear that the improved partition can be used with equal advantage in other types of showers, e.g., in a shower stall which is recessed into a wall or is surrounded by two or three building walls (whose inner sides are coated with tiles or the like) and wherein the partition constitutes the front wall through which the space within the shower is accessible to the user or users. The guide rails which are a must when a shower stall is equipped with a reciprocable door are not needed because two coupling devices 5 suffice to adequately support the door member for pivotal movement between open and closed positions and they also permit for numerous adjustments to compensate for machining and/or other tolerances.

The utilization of separable fasteners (such as 17, 25, 26 and 27) is desirable and advantageous because they render it possible to completely remove a coupling device and/or its parts and/or the door member 4 for the purposes of inspection and/or replacement.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A partition, particularly for use in shower stalls, comprising a fixedly mounted wall member; a door member; and means for movably coupling said door member to said wall member, including a hinge defining a pivot axis about which said door member is swingable with reference to said wall member, and means for mounting said hinge on said wall member so as to permit for adjustments of said door member with reference to said wall member at least in directions at right angles to said pivot axis, said mounting means comprising a substantially horizontal component including a first portion which supports said hinge and a second portion, and several aligned bearings for said second portion, said second portion being movable with reference to said bearings in said directions.

2. The partition of claim 1, wherein at least one of said members includes an upright light transmitting pane.

3. The partition of claim 1, wherein said members have neighboring marginal portions and said door member is swingable between a closed position of substantial parallelism with said wall member and at least one open position, said marginal portions overlapping each other in the closed position of said door member.

4. The partition of claim 3, wherein said mounting means is disposed at one side of said wall member and the marginal portion of said door member overlaps the marginal portion of said wall member at the other side of said wall member in the closed position of said door member.

5. The partition of claim 1, wherein said component includes an elongated bar or rod and at least one of said bearings includes a tubular member wherein said component is slidable in said directions.

6. The partition of claim 5, wherein said pivot axis is at least substantially vertical and said members are disposed in substantially vertical planes, said component being slidable in substantial parallelism with the plane of said wall member.

7. The partition of claim 1, further comprising means for releasably fixing said component to at least one of said bearings.

8. The partition of claim 1, wherein said hinge comprises a first section which is rigid with the first portion of said component and a second section which is rigid with the door member and is pivotable with reference to the first section about said axis.

9. The partition of claim 8, wherein one of said sections is at least substantially arcuate and said members have neighboring upright marginal portions, said door member being swingable with reference to said wall member between a closed position in which said marginal portions overlap each other and at least one open position, said one section extending around and being out of contact with the marginal portion of said wall member in the closed position of said door member.

10. The partition of claim 9, wherein said one section is said second section and said first section is integral with the first portion of said component, said hinge further comprising an at least substantially vertical pintle connecting said sections to each other.

11. The partition of claim 1, wherein one of said bearings includes a substantially tubular element wherein said second portion is slidable in said directions and another of said bearings includes a socket, said second portion having a free end which is receivable in said socket in an end position of said component.

12. The partition of claim 11, further comprising a fixed wall adjacent to said socket, said socket having an end wall and further comprising fastener means for securing said end wall to said fixed wall.

13. The partition of claim 1, further comprising a fixed wall adjacent and disposed substantially at right angles to said wall member, said bearings including a first bearing nearer to and a second bearing more distant from said hinge, and means for at least indirectly affixing said second bearing to said fixed wall.

14. The partition of claim 13, wherein said affixing means comprises an arm rigid with said second bearing.

15. The partition of claim 13, wherein said affixing means comprises a first device for connecting said second bearing to said wall member and a second device for connecting said first device with said fixed wall.

16. The partition of claim 1, wherein said bearings include a first bearing nearer to and a second bearing more distant from said hinge and distancing elements connecting said bearings with said wall member.

17. The partition of claim 16, wherein said distancing elements include spacers which are rigid with the respective bearings and are adjacent to one side of said wall member, said mounting means further comprising fasteners having first portions at the other side of said wall member and second portions extending through said wall member and engaging the respective spacers.

18. The partition of claim 1, further comprising means for adjustably affixing at least one of said one bearing to said wall member.

19. The partition of claim 18, wherein said affixing means comprises a distancing element rigid with said one bearing, a second element carried by said wall member, and a fastener provided on said distancing element and engaging with and being eccentric to said second element so that the position of said distancing element relative to said wall member is changed in response to angular displacement of said second element relative to said wall member about said fastener.

20. The partition of claim 1, further comprising a grub screw for releasably securing the second portion of said component to one of said bearings.

21. The partition of claim 1, wherein said hinge comprises an arcuate first section which abuts against one side of said door member and a second section rigid with the first portion of said component, and further comprising means for securing said first section to said door member including a fastener having an enlarged portion adjacent to the other side of said door member and a second portion extending through said door member and engaging with the first section of said hinge.

22. The partition of claim 21, wherein said members have neighboring elongated marginal portions and said fastener is adjacent to but spaced from the marginal portion of said door member.

23. The partition of claim 1, wherein said bearings include a first bearing nearer to and a second bearing more distant from said hinge, that part of said component which extends between said bearings constituting a towel bar.

24. The partition of claim 1, wherein said wall member has an inner side and an outer side and said component is adjacent to said outer side, said members having neighboring elongated marginal portions and said door member being swingable about said pivot axis between a closed position in which its marginal portion is adjacent to the inner side and overlaps the marginal portion of said wall member and at least one open position in which at least a portion of said door member extends beyond the outer side of said wall member.

25. The partition of claim 1, further comprising means for holding said component against rotation in said bearing.

26. The partition of claim 25, wherein said component includes an elongated bar of at least substantially circular outline and said holding means comprises a spline in said bar and a tongue provided on said bearing and extending into said spline or vice versa.

27. The partition of claim 1, wherein said component is a tube.

28. The partition of claim 1, wherein said component is a solid rod.

29. The partition of claim 1, wherein said members are disposed in substantially vertical planes and said pivot axis is substantially vertical, and further comprising additional coupling means disposed at a level other than said first named coupling means and having a hinge defining a second pivot axis at least substantially coinciding with said first named pivot axis.

* * * * *